US006744345B2

(12) United States Patent
Korczynski et al.

(10) Patent No.: US 6,744,345 B2
(45) Date of Patent: Jun. 1, 2004

(54) MID-RANGE CIRCUIT BREAKER

(75) Inventors: Jacek M. Korczynski, Niles, IL (US); Kerri M. Moore, Palatine, IL (US); Thomas J. Stack, Chicago, IL (US)

(73) Assignee: Cooper Technologies, Houston, TX (US)

( * ) Notice: Subject to any disclaimer, the term of this patent is extended or adjusted under 35 U.S.C. 154(b) by 4 days.

(21) Appl. No.: 10/139,866

(22) Filed: May 6, 2002

(65) Prior Publication Data

US 2003/0206094 A1 Nov. 6, 2003

(51) Int. Cl.[7] ..... H01H 37/52; H01H 37/02

(52) U.S. Cl. ..... 337/358; 337/357; 337/72

(58) Field of Search ..... 337/3, 13, 36–38, 337/41, 53, 56, 62, 63, 66, 68, 72, 76, 85, 86, 357–359; 200/360–366, 520–540

(56) References Cited

U.S. PATENT DOCUMENTS

| | | | | | |
|---|---|---|---|---|---|
| 5,004,994 | A | | 4/1991 | Korczynski et al. | |
| 5,021,761 | A | | 6/1991 | Stack et al. | |
| 5,049,849 | A | | 9/1991 | Sullivan et al. | |
| 5,206,622 | A | * | 4/1993 | Lattari | 337/89 |
| 5,844,464 | A | * | 12/1998 | Kalapodis et al. | 337/140 |
| 5,861,794 | A | * | 1/1999 | Pellon | 337/365 |
| 5,929,742 | A | * | 7/1999 | Short | 337/348 |
| 6,005,471 | A | * | 12/1999 | Higashikata et al. | 337/347 |
| 6,140,903 | A | * | 10/2000 | Kalapodis et al. | 337/140 |
| 6,300,858 | B1 | * | 10/2001 | Kalapodis et al. | 337/140 |
| 6,483,418 | B1 | * | 11/2002 | Reno et al. | 337/379 |
| 6,498,559 | B1 | * | 12/2002 | Cornell et al. | 337/53 |
| 6,538,549 | B1 | * | 3/2003 | Renne et al. | 337/64 |
| 6,559,752 | B1 | * | 5/2003 | Sienkiewicz et al. | 337/53 |
| 6,563,414 | B2 | * | 5/2003 | Yu | 337/66 |
| 6,590,489 | B1 | * | 7/2003 | Ullermann et al. | 337/56 |

OTHER PUBLICATIONS

Klixon® Precision Thermal Circuit Breakers, Texas Instruments, Thermal Circuit Breakers, Jan. 24, 2002, pp. 1–4.

Klixon® Thermal Circuit Breakers—6790 Series, Texas Instruments; Thermal Circuit Breakers, 6790 Series, Aug. 28, 2002; pp. 1–3.

Klixon® Thermal Circuit Breakers, 7851 and 7854 Series, Texas Instruments, Thermal Circuit Breakers, 7851 & 7854 Series, Aug. 28, 2002, pp. 1–4.

Klixon® Thermal Circuit Breakers, PDM and PDA Series, Texas Instruments, Thermal Circuit Breakers, PDM & PDA Series, Aug. 28, 2002, pp. 1–4.

* cited by examiner

*Primary Examiner*—Anatoly Vortman
(74) *Attorney, Agent, or Firm*—Armstrong Teasdale LLP

(57) ABSTRACT

A circuit breaker includes a base housing comprising a contact cavity therein, first and second terminals at least partially located within said contact cavity, and a thermal trigger element fixedly coupled to said first terminal and in electrical contact with said second terminal in normal operation is provided. The thermal element is configured to activate and break electrical contact with said second terminal upon a predetermined current condition.

20 Claims, 7 Drawing Sheets

MID-RANGE CIRCUIT BREAKER

BACKGROUND OF THE INVENTION

This invention relates generally to circuit breakers and, more particularly, to thermal circuit breakers.

Circuit breakers are electrical circuit protective devices that interrupt a flow of current when the current exceeds a specified value, sometimes referred to as an overcurrent value. In an overcurrent condition, the circuit breaker rapidly separates a pair of contacts that normally conduct the current. Circuit wiring and associated circuit components may therefore be isolated from potentially damaging and undesirable exposure to excess currents. Conventionally, the circuit breakers are either thermally or magnetically actuated.

One type of known thermal circuit breaker includes a nonconductive housing with conductive line and load contact terminals therein for electrical connection to a circuit to be protected. A temperature responsive element, sometimes referred to as thermal trigger element, is extended across the line and load contacts, and when the breaker is connected to an energized circuit, current flows between the breaker contacts through the trigger element in normal operation. Current flow through the trigger element heats the trigger element, and when current flow exceeds a predetermined level, the trigger element trips, deflects, or deforms to an activated position separated from each of the breaker contacts, thereby breaking the current through the breaker and protecting load side electrical devices.

While thermal circuit breakers for interrupting DC current, such as those for auxiliary and accessory circuits for recreational vehicles and marine applications, are commercially available, known circuit breakers tend to be rated for protecting "low amp" circuits of about 50 amps or less in 30 Vdc electrical systems or less, or rated for interrupting "high amp" currents substantially greater than 50 amps, such as 100 amps or more in 30 Vdc electrical systems. In mid-range applications between these extremes, e.g., current values up to about 60 amps, low amp breakers are inadequate for use while high amp breakers are over designed and hence not efficient or cost effective. An alternative breaker construction for mid-range applications is therefore desired.

Additionally, some thermal circuit breakers include manual reset and manual trip features to interrupt the breaker circuit independently of thermal conditions. Implementing such features can lead to relatively complicated constructions that increase manufacturing and assembly costs of the breaker.

BRIEF DESCRIPTION OF THE INVENTION

In one aspect a circuit breaker is provided that comprises a base housing comprising a contact cavity therein, first and second terminals at least partially located within said contact cavity, and a thermal trigger element fixedly coupled to said first terminal and in electrical contact with said second terminal in normal operation. The thermal element is configured to activate and break electrical contact with said second terminal upon a predetermined current condition.

In another aspect, a circuit breaker is provided that comprises a base housing comprising a contact cavity therein, first and second terminals at least partially located within said contact cavity, a thermal trigger element extending between said first and second terminals, and a reset actuator situated within said contact cavity. The reset actuator comprises a shaft and a reset ledge extending from said shaft, said trigger element contacting said reset ledge when trigger element is activated, thereby rotating said shaft.

In yet another aspect, a circuit breaker is provided that comprises a base housing comprising a contact cavity therein, first and second terminals at least partially located within said contact cavity, a thermal trigger element extending between said first and second terminals, and a trip actuator situated within said contact cavity. The trip actuator comprises at least one leg, a stabilizer coupled to said leg, and an engagement surface offset from said stabilizer to produce pivoting movement about the stabilizer.

In another aspect, a circuit breaker is provided. The circuit breaker comprises a base housing comprising a contact cavity therein, first and second terminals at least partially located within said contact cavity, a thermal trigger element fixedly coupled to said first terminal and in electrical contact with said second terminal in normal operation, said thermal element configured to activate and break electrical contact with said second terminal upon a predetermined current condition, and a cover comprising attached to said base, said cover comprising an outer surface and an overmolded gasket substantially covering said outer surface.

In another aspect, a circuit breaker for mounting to an electrical distribution panel is provided. The circuit breaker comprises a base housing comprising a contact cavity therein and a lower outer periphery, first and second terminals at least partially located within said contact cavity, and a thermal trigger element in electrical contact with said first terminal and said second terminal in normal operation, said thermal element configured to activate and break electrical contact with said second terminal upon a predetermined current condition. A cover assembly is attached to said base housing and comprises an upper outer periphery, said upper outer periphery and said lower outer periphery shaped to be received in a single panel cut-out pattern.

DETAILED DESCRIPTION OF THE INVENTION

Figure 1:
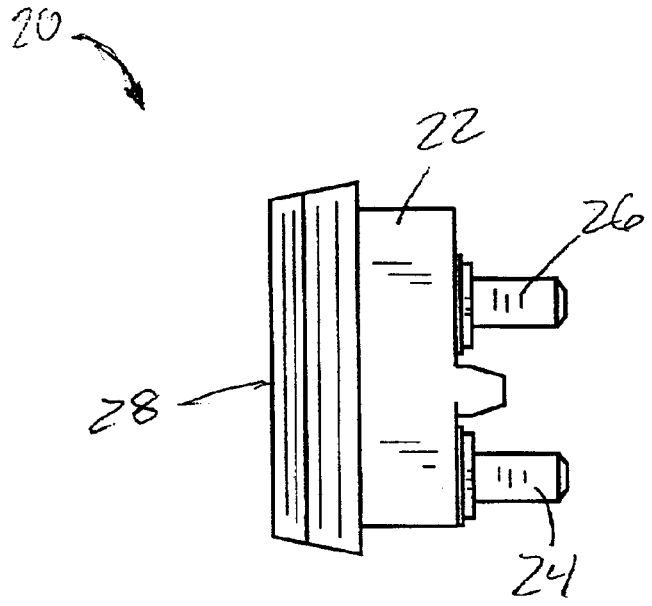
FIG. 1 is side elevational view of a mid-range circuit breaker.

FIG. 1 is side elevational view of a first embodiment of a mid-range circuit breaker 20 that is well suited for mid-range breaker applications, including but not limited to auxiliary and accessory circuits for recreational vehicles and marine applications. Circuit breaker 20 includes a nonconductive base or housing 22 including a trigger element (described below) extending between a line terminal 24 and a load terminal 26, and a protective cover 28 to enclose the trigger element within base housing 22. Line terminal 24 and load terminal 26 extend from base housing 22 for respective line-side and load-side electrical connection to a circuit to be protected. In the illustrated embodiment, line and load terminals 24, 26 are threaded copper studs fabricated according to known methods in the art, although it is contemplated that other known terminal configurations may be provided in lieu of terminal studs 24, 26 in alternative embodiments.

In an exemplary embodiment, base housing 22 is fabricated from an engineered plastic material according to a known molding process. In a particular embodiment, for example, base housing 22 is fabricated from a mineral filled phenolic molding compound, such as PLENCO 03356 commercially available from Plastics Engineering Company of Sheboygan, Wis. It is recognized that other known materials and processes may be employed to fabricate base housing 22 to withstand anticipated operating environments and conditions of breaker 20 in use without deteriorating. Additionally, in an illustrative embodiment base housing 22 is molded around line and load terminals 24, 26 such that terminals 24, 26 are permanently fixed to housing 22, while in alternative embodiments terminals 24, 26 may be attached to housing 22 after housing 22 is formed using known fasteners and techniques.

As explained more fully below, cover 28 is separately fabricated and in one embodiment includes a sealing gasket to prevent water and external contaminants from infiltrating base housing 22 and affecting operation of the thermal trigger element therein. Cover 28 is securely attached to base housing 22 with known techniques, including but not limited to eyeleting techniques.

Figure 2:
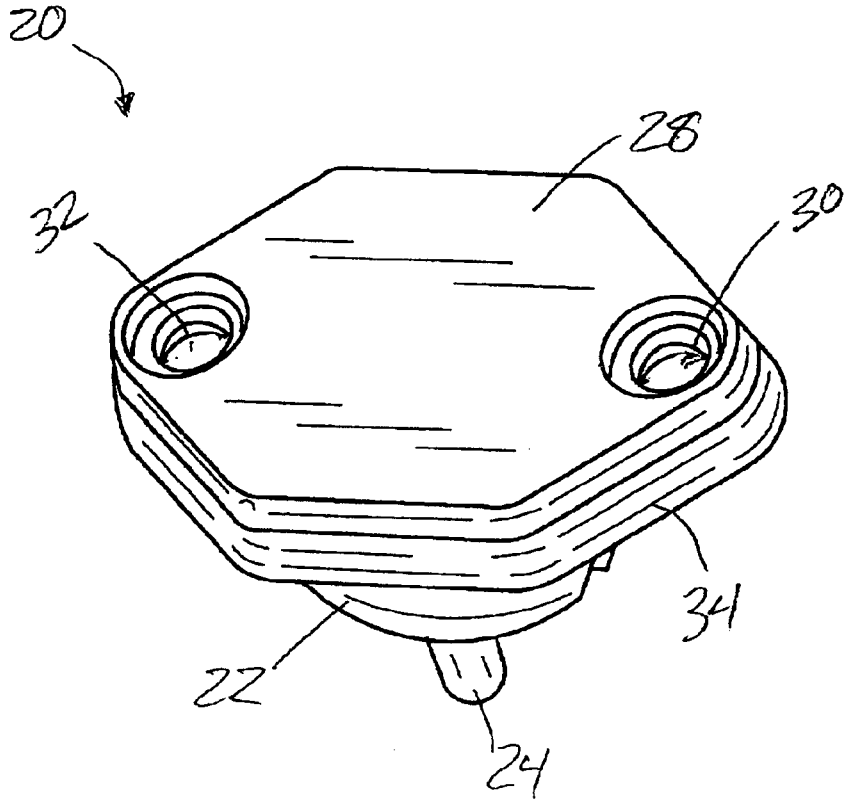
FIG. 2 is a perspective view of the circuit breaker shown in FIG. 1.

FIG. 2 is a perspective view of circuit breaker 20 illustrating cover 28 attached to base housing 22 and including mounting fastener through-holes 30, 32 extending through cover 28 and through a rim 34 of base 22. A known fastener or fasteners, such as a conventional screw and nut or threaded inserts, may be employed with one or both of through-holes 30, 32 to mount circuit breaker 20 to an electrical distribution panel (not shown in FIG. 2).

Figure 3:
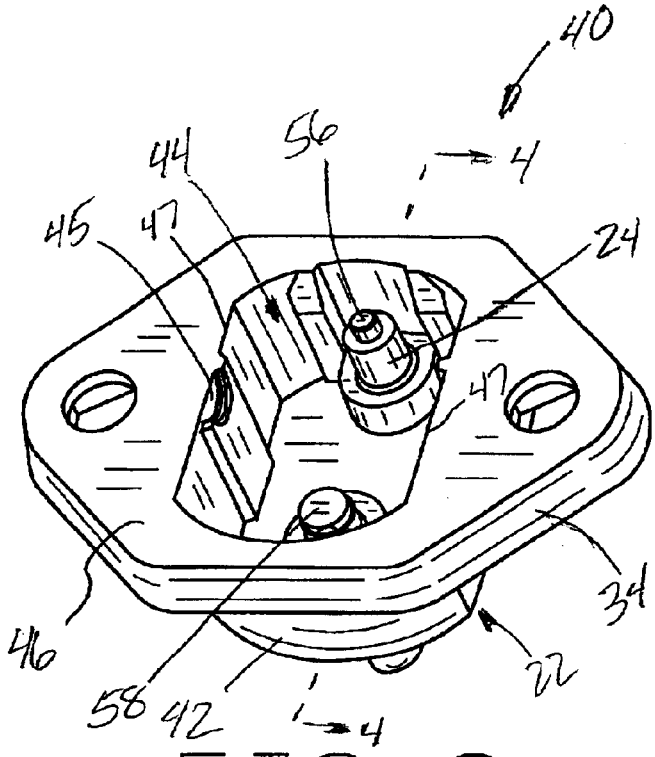
FIG. 3 is a perspective view of a base housing assembly for the circuit breaker shown in FIGS. 1 and 2.
Figure 4:
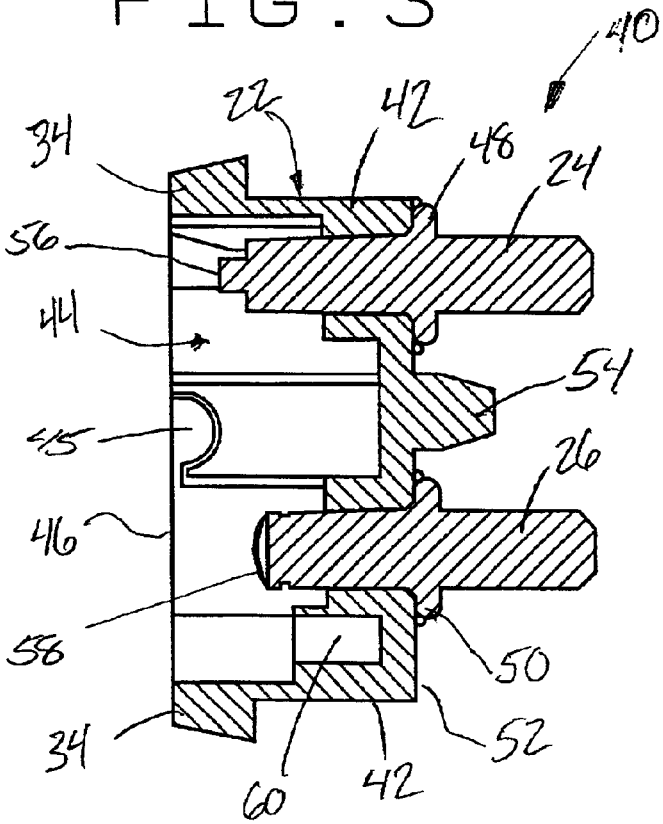
FIG. 4 is a cross sectional view of the base housing assembly along line 4—4 of FIG. 3.

FIGS. 3 and 4 are a perspective view and a cross sectional view, respectively, of a base housing assembly 40 for circuit breaker 20 (shown in FIGS. 1 and 2) with cover 28 (shown in FIGS. 1 and 2) removed. Base housing 22 includes a lower contact portion 42 and upper rim 34 extending therefrom. Housing 22 is shaped to facilitate either front or back panel mounting to an electrical distribution panel (not shown in FIGS. 3 and 4) in a circular panel cutout, thereby simplifying installation in comparison to known polygonal shaped circuit breakers that are more difficult to cut out of the panel.

Base lower contact portion 42 includes molded-in stud terminals 24, 26 extending into a contact cavity 44 beneath a top surface 46 of base upper rim 34. Terminals 24, 26 each include respective annular stops 48, 50 contacting a lower surface 52 of base contact portion 42, and base contact portion 42 includes an integral contact barrier 54 extending between terminals 24, 26 to facilitate separation of line and load connections (not shown) of the electrical circuit to be protected and to prevent a short circuit. Contact cavity 44, in one embodiment, includes a cradle 45 in each of opposite longitudinal side walls 47 of contact cavity 44. Cradles 45 accommodate a breaker trip actuator (described below).

Each of terminals 24, 26 is generally cylindrical in shape, and line terminal 24 includes a cylindrical head 56 of lesser diameter than a remainder of terminal 24 that is located within base contact cavity 44. Line terminal head 56 thus forms a projection atop line terminal 24 that serves to connect line terminal 24 with the thermal trigger element of breaker 20 (described further below).

Load terminal 26 includes a contact crown 58 on top of load terminal 56 that facilitates electrical connection with the thermal trigger element attached to line terminal head 56. In an exemplary embodiment, load terminal crown 58 is braized to load terminal 26 and is formed with a silver cadmium oxide (AgCdO) composition with a coining operation to a specified spherical radius, thereby forming crown 58 of adequate height to establish electrical contact with the trigger element. In a further embodiment, load terminal 26 is finished with a nickel plating of at least about 0.003 mm thickness according to known methods and techniques.

In further and/or alternative embodiments, other finishing processes and compositions may be employed to ensure and/or enhance electrical contact of load terminal 26 and the thermal trigger element, such as with contact crown 58.

In one embodiment, base housing contact portion 42 further includes a recessed cavity 60 adjacent to load terminal stud to accommodate a breaker tripping mechanism (described below).

Figure 5:
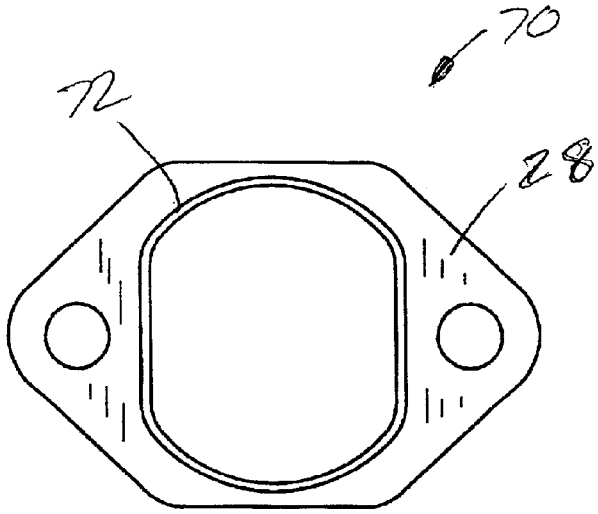
FIG. 5 is a bottom elevational view of a cover assembly for the circuit breaker shown in FIGS. 1 and 2.

FIG. 5 is a bottom elevational view of a cover assembly 70 for breaker 20 (shown in FIGS. 1 and 2) including cover 28 with a sealing gasket 72 attached thereto for sealing engagement of cover 28 with breaker base housing 22 (shown in FIGS. 1–4). When cover 28 is attached to base housing 22, gasket 72 seals a periphery of base housing contact cavity 44 (shown in FIGS. 3 and 4). In one embodiment, cover 28 is fabricated from a thermoplastic polymer and the like according to known molding techniques. In a particular embodiment, for example cover 20 is fabricated from a CELANEX®polymer commercially available from Celanese Corporation of New York, N.Y.

Further, in an exemplary embodiment, gasket 72 is fabricated from a thermoplastic elastomer and the like using an overmolding process. In a particular embodiment, for example, gasket 72 is fabricated from a SANTOPRENE® seal material commercially available from Monsanto Company of St. Louis, Mo. Further, gasket 72 covers both sides of cover 28 to provide a seal both with respect to base housing 22 and a panel (not shown in FIG. 5) of an electrical distribution system. Overmolding of the entire cover 28, i.e., both sides of cover 28, avoids the use and associated assembly costs of multiple gaskets in breaker 20. It is appreciated, however, that in alternative embodiments, gasket 72 may cover only selected portions of cover 28 while still achieving at least some of the advantages of the instant invention.

It is contemplated that other materials capable of use in a circuit breaker environment are known in the art and that these and other materials may be employed to fabricate cover 28 and gasket 72 without departing from the scope of the present invention.

Figure 6:
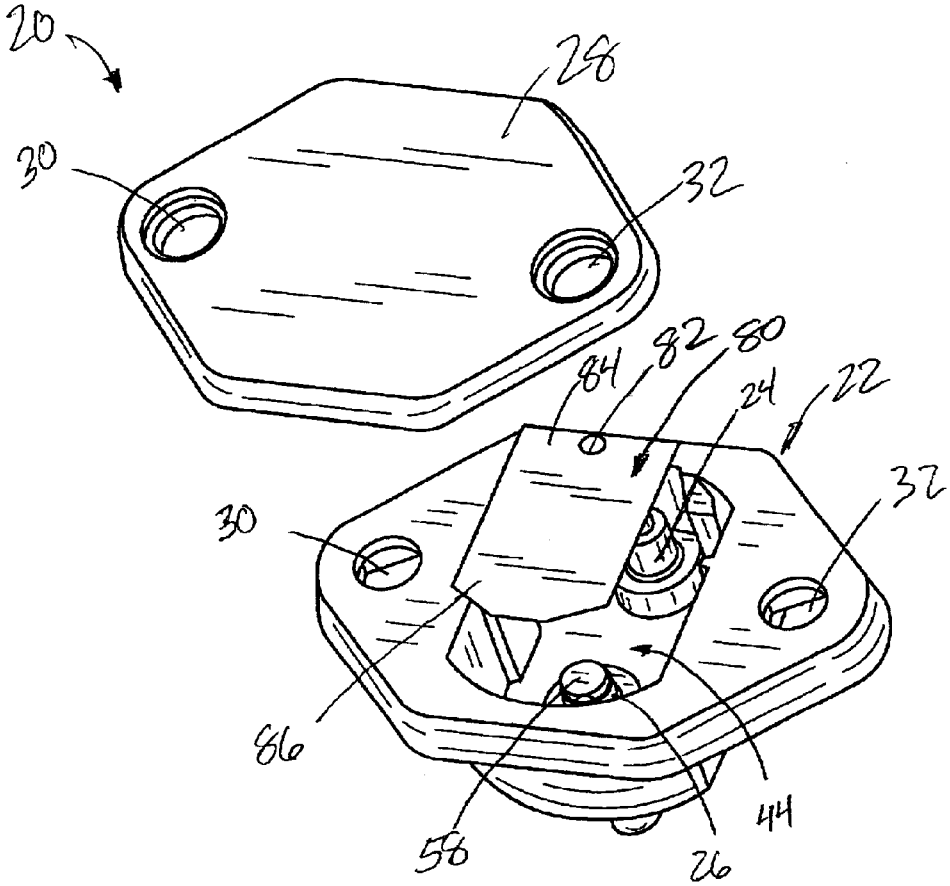
FIG. 6 is an exploded assembly view of the circuit breaker shown in FIGS. 1 and 2.

FIG. 6 is an exploded assembly view of circuit breaker 20 illustrating a thermal trigger element 80 that completes or breaks an electrical connection through breaker 20 when breaker 20 is connected to an energized circuit. Thermal trigger element 80 in the illustrated embodiment is substantially rectangular and includes an opening 82 at one end 84 thereof for attachment of trigger element 80 to line side terminal 24, and also includes an opposite tapered end 86 for establishing electrical contact with load terminal 26.

In an illustrative embodiment, trigger element 80 is staked to head 56 (also shown in FIGS. 3 and 4) of line terminal 24 (shown in FIGS. 1, 2, and 4) through trigger element opening 82. A secure mechanical and electrical connection is therefore provided between trigger element 82 and line terminal 24. At trigger element end 86, a bottom surface of trigger element 86 contacts load terminal crown contact 58 when trigger element 82 is coupled to line terminal 24 and breaker 20 is operating normally. Thus, a circuit path is completed through breaker 20 and current flows through trigger element 80 between terminals 22, 24 when breaker 20 is connected to an energized circuit. However, when current approaches a predetermined threshold, dependant upon characteristics of trigger element 80, trigger element 80 is heated to an activation temperature that causes trigger element to activate and displace the bottom surface of trigger element end 86 from load terminal contact crown 58, thereby opening the circuit path and breaking the electrical connection through breaker 20.

In one embodiment trigger element 80 is fabricated from a known thermal material that is temperature responsive to activate trigger element 80 upon the occurrence of designated current conditions. For example, a metal alloy which is configured to react to heat generated by current flow through thermal material 14 may be employed to fabricate trigger element 80, and when trigger element 80 is exposed to a predetermined overcurrent condition, trigger element 80 reacts and assumes a shape that prevents a surface of trigger element end 86 from contacting load terminal crown contact 58, such as a convex shape that causes trigger element end 86 to assume, for example, an arched configuration. The reaction of the trigger element and the assumption of an activated shape causes breaker contact 26 to break electrical (and physical) contact with load terminal 26, thereby opening the protected circuit established through breaker 20.

In another embodiment, trigger element 80 is a bimetal thermal trigger element constructed from two dissimilar metals bonded together according to known techniques. When trigger element 80 is heated to a specified temperature, internal stresses of the metals and differences in the coefficient of expansion of the metals cause the trigger element to deflect and separate from load terminal crown contact 58 at end 86.

In further embodiments, trigger element 80 may include surface treatments, such as small indentations or dimples one or both side surfaces to accentuate a temperature response of the trigger element for activation or resetting of the element. Additionally, different amperage ratings for trigger element 80 may be obtained by varying the indentations of dimples on trigger element 80.

Once trigger element 80 is coupled to line terminal 24 such that trigger element end 86 contacts load terminal crown contact 58, cover 28 is attached to base housing 22 according to techniques known in the art, and cover seal 72 (shown in FIG. 5) forms a sealed connection that prevents external contaminants from entering base contact cavity 44 and compromising proper operation of circuit breaker 20. Circuit breaker 20 may be mounted to a breaker panel via through-holes 30, 32, and when line and load terminals 24, 26 are coupled to energized circuitry, breaker 20 is operable to interrupt or trip the circuit when current through breaker 20 reaches undesirable levels.

After breaker 20 has tripped, the activated trigger element 80 gradually cools and returns or resets to its initial shape. As trigger element 80 resets, trigger element end 86 eventually contacts load terminal crown contact 58, and the electrical connection through breaker 20 is again established.

In a particular embodiment, breaker 20 is rated for interrupting currents up to about 60 amps in 30 Vdc electrical systems. As such, circuit breaker 20 is more economical in these applications than conventionally used high amp circuit breakers that are designed for much higher currents.

Figure 7:
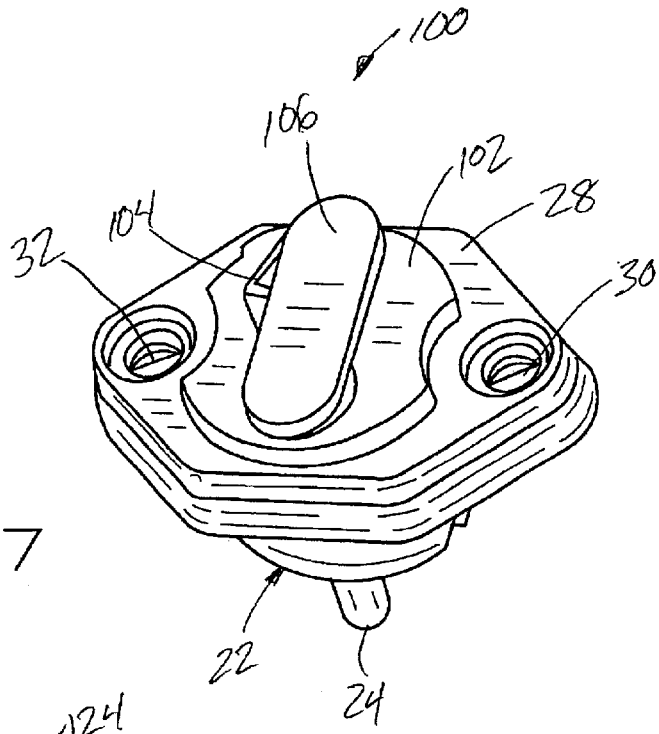
FIG. 7 is a perspective view of a second embodiment of a mid-range circuit breaker.

FIG. 7 is a perspective view of a second embodiment of a mid-range circuit breaker 100 that, unlike breaker 20 (described above in relation to FIGS. 1–6) must be manually reset after the circuit breaker trips in an overcurrent condition. For the sake of brevity, common elements of circuit breakers 20 and 100 are indicated with like reference characters, and, except as noted, the construction of breakers 20 and 100 is substantially similar.

Breaker 100 includes line and load terminals 24, 26 extending from base housing 22, and cover 28 is attached to base housing 22 as described above. Unlike breaker 20, however, cover 28 of breaker 100 includes a raised surface 102 to which a manual reset switch element 104 and a reset switch guard 106 are each coupled. Guard 106 is mounted stationary to cover raised surface 102, and reset element 104 is positionable between a normal position located substantially completely beneath actuator guard 106 so that reset switch element 104 is generally not visible in normal operation of breaker 100, and an activated position extending from actuator guard 106 when circuit breaker 100 is tripped. When breaker 100 is tripped, reset element 104 visibly protrudes at an angle from beneath actuator guard 106 and is clearly visible to indicate that circuit breaker 100 has tripped. Once tripped, breaker 100 remains in a tripped state until reset element 104 is moved back to the normal position.

In one embodiment, to enhance circuit breaker state identification, i.e., whether breaker 100 is tripped to interrupt the electrical circuit or untripped for normal operation of the circuit, breaker base housing 22, cover 28, and actuator guard 106 are of a contrasting color relative to a color of actuator 104. For example, in one embodiment, base housing 22, cover 28, and actuator guard 106 are black while reset element 24 is yellow. Of course, other colors may be used in alternative embodiments to enhance visual state indication of breaker 100.

Figure 8:
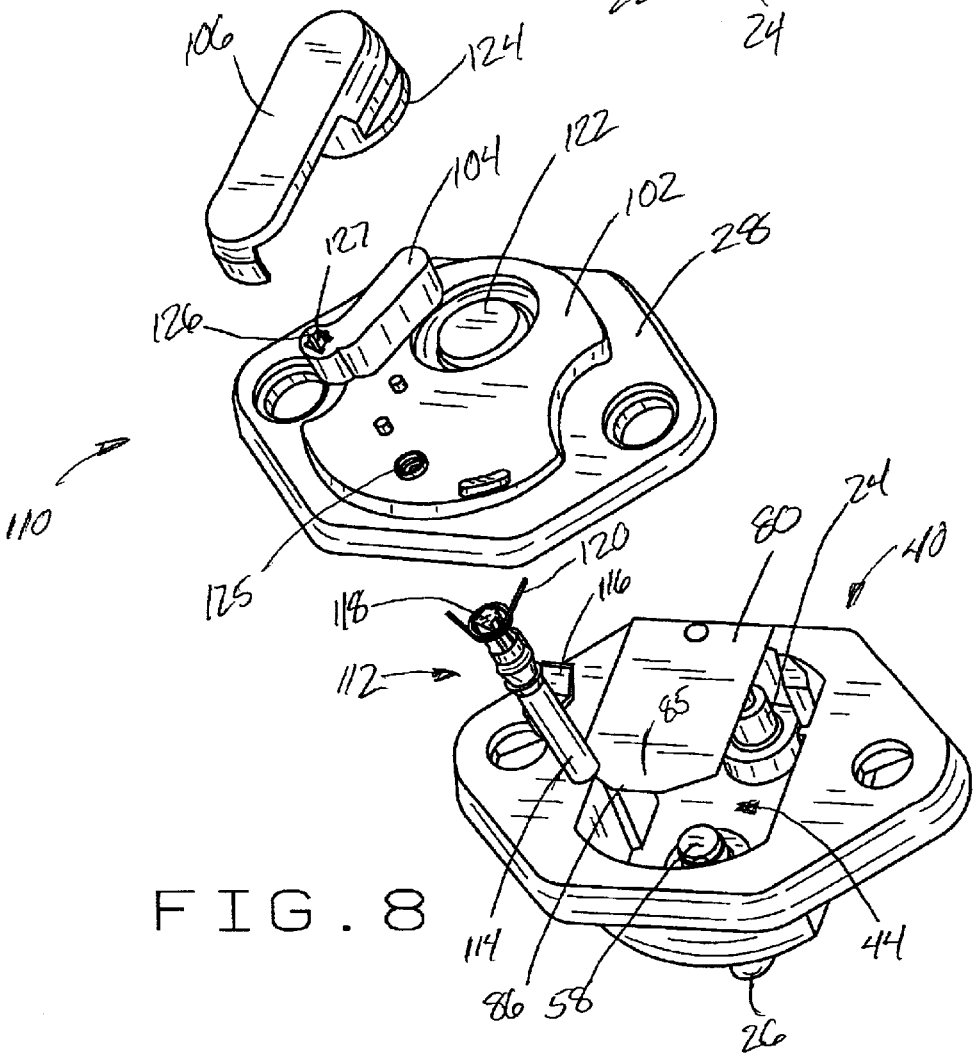
FIG. 8 is an exploded assembly view of the circuit breaker shown in FIG. 7.

FIG. 8 is an exploded assembly view of circuit breaker 100 including base housing assembly 40 substantially as described above in relation to FIGS. 3 and 4, trigger element 80 substantially as described above in relation to FIG. 6, a cover assembly 110, and reset actuator 112.

Reset actuator 112 in an illustrative embodiment is a substantially cylindrical shaft 114 including a reset ledge 116 extending radially therefrom, a head portion 118 at a top end of shaft 114, and a biasing element 120.

Cover assembly 110 includes cover 28 with raised surface 102, and reset element 104 and reset cover 106 are securely coupled to raised surface 102. A gasket seal 122 is coupled to the underside of cover 28 to form a sealed connection to base housing assembly 40 about a periphery of base housing contact cavity 44. In an exemplary embodiment, gasket 122 is an overmolded thermoplastic elastomer as described above in relation to FIG. 5, and in the illustrated embodiment is formed to accommodate a round end 124 of actuator guard 106 where actuator guard 106 attaches to breaker cover 28.

When assembled, actuator shaft 114 extends into base housing recessed cavity 60 (shown in FIG. 4) near load terminal 26, and reset actuator head 118 extends though an opening 125 in cover 28 and is coupled to a mating end 126 of reset element 104 including an opening 127 complementary in shape to actuator head 118. Actuator element opening 127 receives actuator head 118 with a tongue and groove, or splined arrangement to prevent relative rotation between reset element 104 and reset actuator 112. Thus, as reset element 104 is pivoted about end 126, actuator shaft 114 is rotated, and vice versa.

Trigger element 80 is coupled to line terminal 24 and is also in contact with load terminal crown contact 58 in the normal position, and reset actuator ledge 116 extends radially from actuator shaft 114 and is angularly biased against a trigger element contact 85 protruding from trigger element end 86 in normal operation of circuit breaker 100. Current therefore flows through trigger element 80 between terminals 24, 26 substantially as described above in relation to breaker 20.

When trigger element 80 activates, however, deflection of trigger element end 86 causes trigger element end 86 to release actuator reset ledge 116. Because reset ledge is angularly biased against trigger element contact 85 and is radially offset from a longitudinal axis of actuator shaft 114, deflection of trigger element end 86 releases reset ledge 116, which is biased by bias element 120 to position the reset ledge 116 between contact crown 58 and trigger element contact 85. As actuator shaft 114 rotates, reset element 104 is moved out from under actuator guard 106 to indicate that trigger element 80 has activated and that breaker 100 is tripped. Bias element 120 assists movement of actuator element 104 to the activated position extending clearly from actuator guard 106.

To reset breaker 100, actuator element 104 is moved back underneath actuator guard 106 against the bias of element 120. Actuator shaft 114 coupled to actuator element end 106 is therefore rotated, and reset ledge 116 is swept away from between trigger element contact 85 and contact crown 58. As reset element 104 is moved toward the normal position underneath actuator guard 106, actuator shaft 114 continues to be rotated and reset ledge 116 evacuates the space between trigger element contact 85 and contact crown 58, therefore applying mechanical force to trigger element end 86. This causes trigger element contact 85 to reset to its normal position in contact with terminal crown contact 58. When trigger element 80 assumes the normal position, the electrical connection through breaker 100 is re-established, and breaker 100 is again ready for use.

Breaker 100 in an exemplary embodiment is rated for carrying currents up to about 60 amps in 42 Vdc electrical systems. As such, circuit breaker 100 is more economical for mid-range applications than conventionally used high amp circuit breakers that are designed for much higher currents and higher voltages.

Figure 9:
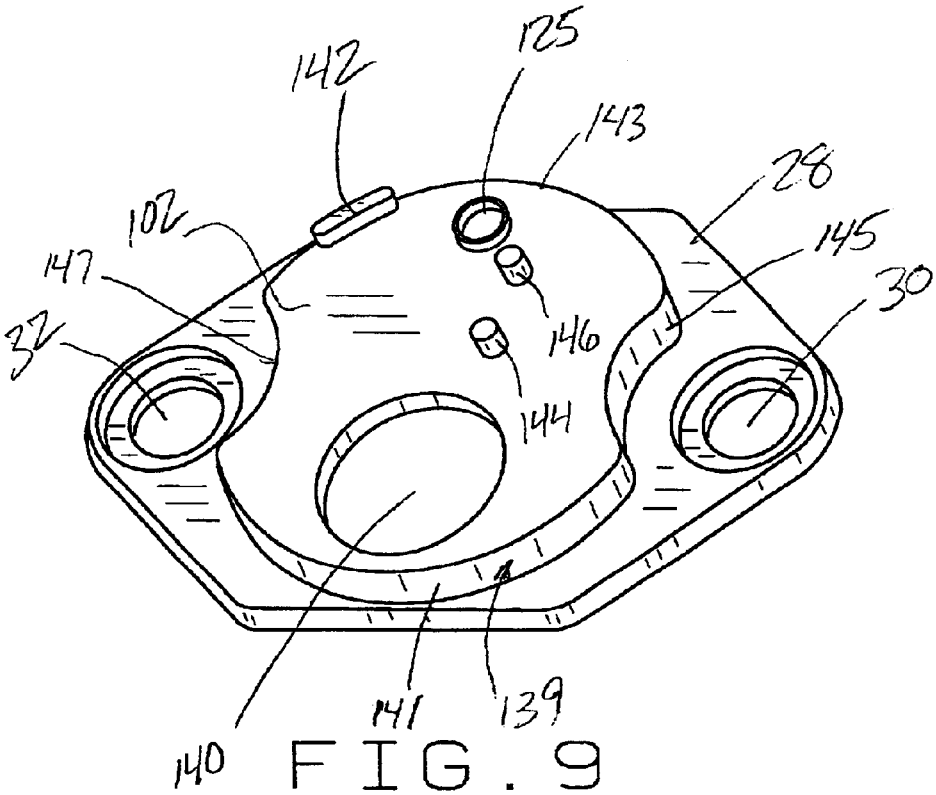
FIG. 9 is a top perspective view of a cover for the circuit breaker shown in FIGS. 7 and 8.
Figure 10:
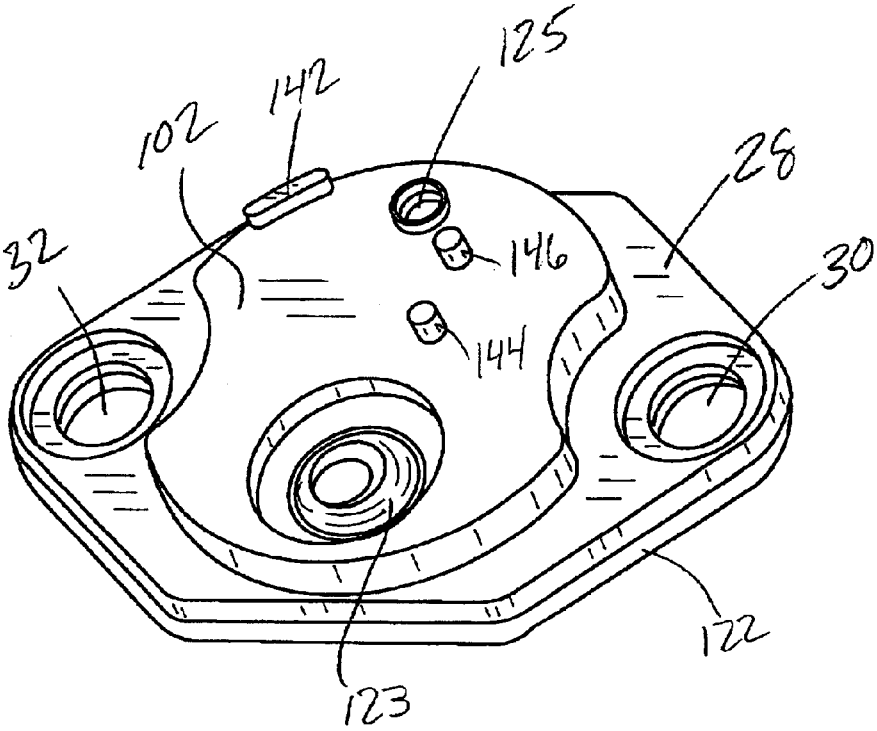
FIG. 10 is a top perspective view of a cover assembly for the circuit breaker shown in FIGS. 7 and 8.

FIGS. 9 and 10 are top perspective views of cover 28 before and after, respectively, gasket 122 is applied for breaker 100.

In an exemplary embodiment, cover 28 is formed with raised surface 102, reset actuator through-hole 125 and a trip mechanism through-hole 140 in addition to breaker mounting through-holes 30, 32. Cover raised surface 102 is contoured adjacent mounting through-holes 30, 32 and resembles the shape of a badge on an outer periphery 139 thereof. Outer periphery 139 includes opposite convex portions 141, 143 with concave portions 145, 147 extending therebetween. As will be appreciated below, cover outer periphery 139 facilitates front panel mounting to an electrical distribution panel (not shown in FIGS. 9 and 10).

A reset element activation stop 142 projects upward from cover raised surface 102 and serves to limit movement of actuator element 104 (shown in FIG. 8) beyond the activation position (described above) as breaker 100 (shown in FIG. 8) trips. Further, a pair of weld attachment projections 144, 146 project upward from cover raised surface 102 and serve to facilitate attachment of actuator guard 106 to raised surface 102, such as with sonic welding techniques in an exemplary embodiment.

In one embodiment, cover 28, raised surface 102, through holes 30, 32, 125, and 140, and attachment projections 142, 146 are fabricated integrally from a thermoplastic polymer, such as a CELANEX® polymer commercially available from Celanese Corporation of New York, N.Y. according to a known molding process. It is appreciated, however, that the through holes, attachment projections, cover raised surface and other features could be formed otherwise according to known techniques in multiple manufacturing steps and/or from assembled component parts.

Gasket 122 substantially covers an entire outer surface of cover 28, except where through-holes 30, 32 and 125 are located. Gasket 122 includes an expandable bellows portion 123 extending partially upwardly through trip mechanism through-hole 140 in cover 28 to accommodate a trip element (not found in breaker 100 but described below) and allow for mechanical actuation of the trip element without compromising the gasket seal. Therefore, when actuator guard 106 (shown in FIGS. 7 and 8) is coupled to cover raised surface 102, a secure seal is established about trip mechanism through-hole 140. Gasket 122, like gasket 72 described above, is fabricated from a thermoplastic elastomer, such as a SANTOPRENE® seal material commercially available from Monsanto Company of St. Louis, Mo. in an overmolding operation. It is contemplated, however, that other known materials capable of use in a circuit breaker environment may be employed to fabricate cover 28 and gasket 122 without departing from the scope of the present invention. Further, gasket 122 need not cover the entire outer surface of cover 28 in alternative embodiments, but rather only selected portions thereof.

Figure 11:
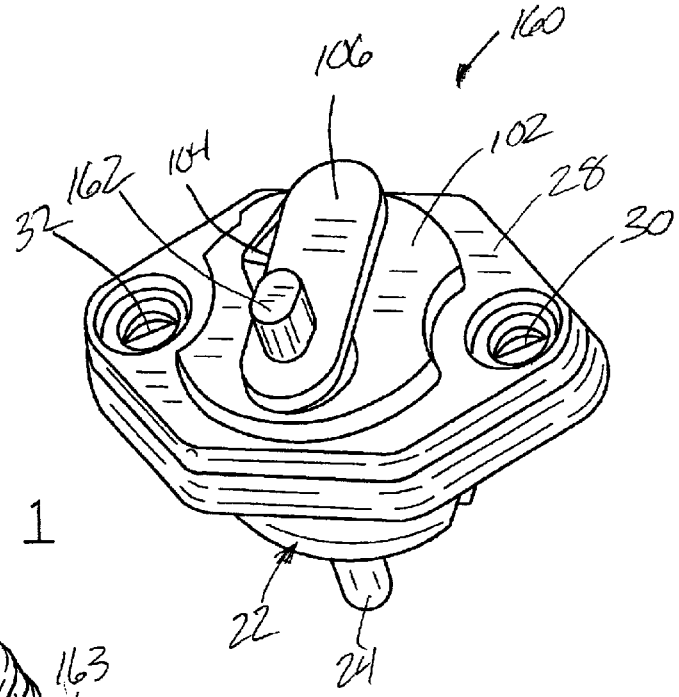
FIG. 11 is top perspective view of a third embodiment of a mid-range circuit breaker.

FIG. 11 is top perspective view of a third embodiment of a mid-range circuit breaker 160 that, unlike breaker 100 (shown in FIGS. 7 and 8), includes a trip element 162 extending through reset element cover 106. For the sake of brevity, common elements of circuit breakers 100 and 160 are indicated with like reference characters, and, except as noted, the construction of the elements between breakers 100 and 160 are substantially similar. Trip element 162, when actuated, causes the breaker trigger element to assume an activated position to trip the breaker, as further explained below.

Figure 12:
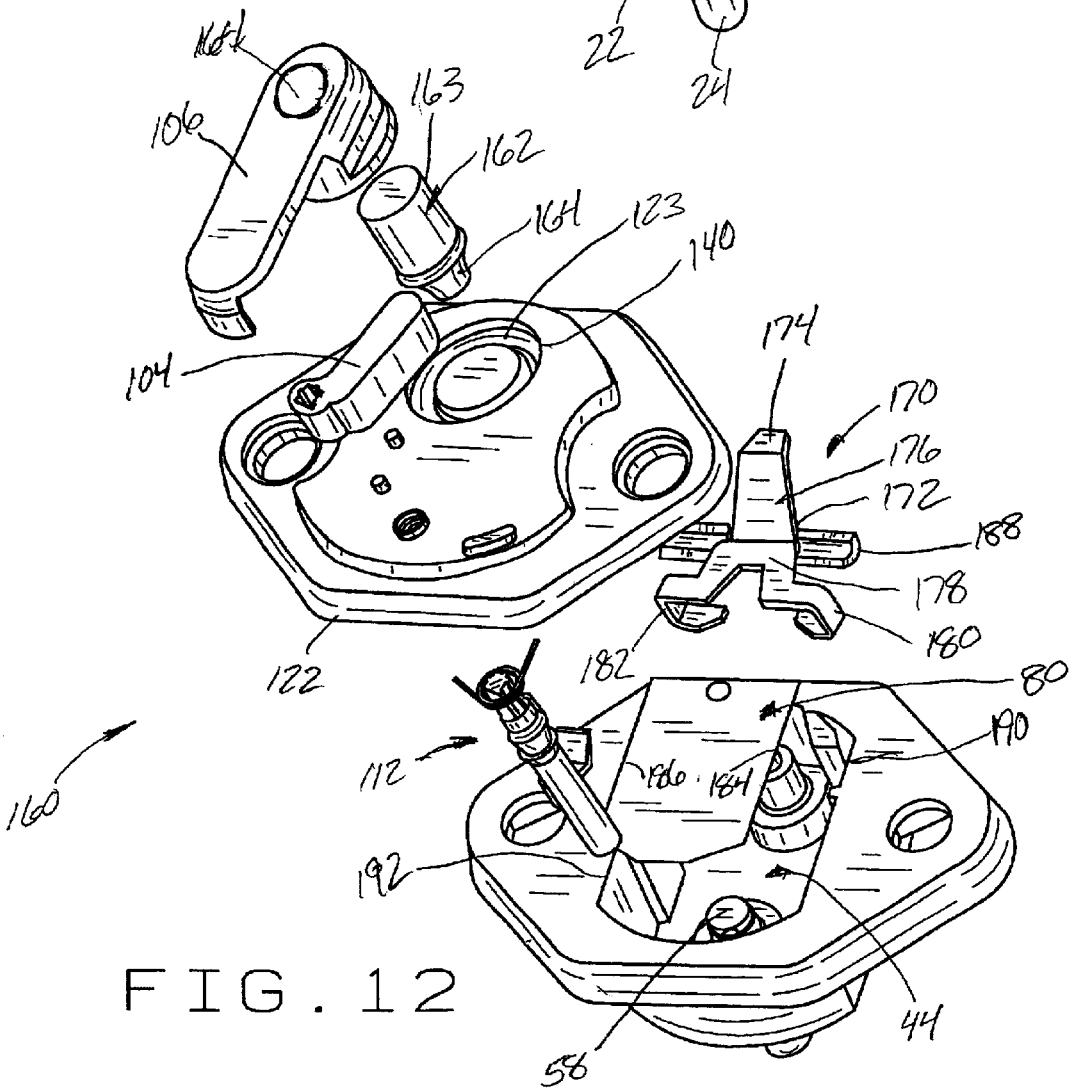
FIG. 12 is an exploded assembly view of the circuit breaker shown in FIG. 11.

FIG. 12 is an exploded assembly view of circuit breaker 160 illustrating trip element 162 located beneath one end of reset actuator guard 106, and an upper end 163 of trip element 162 extends through an opening 164 in actuator guard 106 so that a user may manipulate trip element 162. A lower end 164 of trip element 162 extends through trip mechanism through hole 122 in cover 28 and extends or expands gasket bellows portion 123 located in trip mechanism through-hole 140. The expanded bellows portion of gasket 122 therefore surrounds lower end 164 of trip element 162 and prevents water and contaminants from entering base housing contact cavity.

A trip actuator 170 includes a body 172 having a flat, substantially horizontal engagement surface 174 atop a substantially vertically inclined extension portion 176. A substantially horizontal extension portion 178 extends from a lower end of tapered vertical extension portion 178, and extension portion 178 is bifurcated on a distal end thereof into a pair of legs 180, 182 each forming a U-shaped channel that receive respective lateral sides 184, 186 of trigger element 80. Trip actuator 170 further includes a substantially horizontal stabilizer arm 188 extending outward approximately from the intersection of vertical extension portion 176 and horizontal extension portion 178. Stabilizer arm 188 extends between side walls 190, 192 and each end thereof is received in respective cradles 45 (shown in FIG. 3) of base housing contact cavity 44. Trip actuator 170 is therefore maintained in a substantially vertical orientation within base housing contact cavity 44. In overall appearance, and as illustrated in FIG. 12, trip actuator 170 somewhat resembles a reclined stick figure with outstretched arms.

Trip element 162 is fabricated in an illustrative embodiment from known insulative (i.e., non-electrically conductive) materials according to known methods and techniques in the art. Additionally, to distinguish trip element 162 from a remainder of breaker 160 and minimize unintentional actuation of trip element 106, trip actuator 162 in an exemplary embodiment is of a contrasting color relative to breaker actuator guard 106. For example, in a particular embodiment, trip element 162 is red while actuator guard 106 is black. Of course, other distinctive color schemes may be employed in alternative embodiments.

When properly positioned within base housing contact cavity 44, trigger element edges 184, 186 are extended through the U-shaped channels of trip actuator legs 180, 182, and trip actuator engagement surface 174 is positioned just beneath lower end 164 of trip element 162. Therefore, when trip element 162 is depressed, trip actuator engagement surface 174 is displaced downwardly by trip element lower end, causing a pivoting or rocking movement of trip actuator 170 about an axis through actuator stabilizer arm 188 within base housing contact cavity cradles 45. As trip actuator 170 pivots, actuator legs 180, 182 engage trigger element lateral edges 184, 186 and apply a force to trigger element edges 184, 186 until trigger element 80 mechanically deflects to the tripped or activated position to break electrical contact with load terminal contact crown 58. When trigger element 80 is activated, reset actuator 112 is rotated as described above, causing reset element 104 to move to the activated position. By manipulating reset element 104 back to the normal position, breaker 160 may be manually reset as set forth above. Thus, by manipulating trip element 162 and reset element 104, breaker 160 may be switched on and off to interrupt and reset the associated circuit connected to breaker 160.

When current reaches a predetermined overcurrent level, breaker 160 operates substantially as described above in relation to breaker 100.

In an exemplary embodiment, breaker 100 is rated for carrying currents up to about 60 amps in 30 Vdc electrical systems. As such, circuit breaker is more economical for mid-range applications than conventionally used high amp circuit breakers that are designed for much higher currents.

Figure 13:
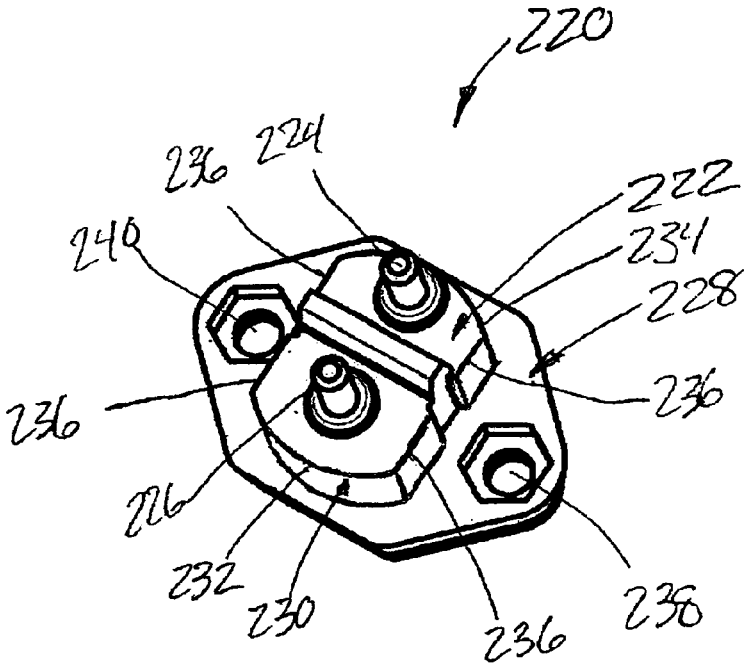
FIG. 13 is a bottom perspective view of a circuit breaker.

FIG. 13 is a bottom perspective view of a circuit breaker 220 illustrating another aspect of the invention. Circuit breaker 220, in different embodiments, may be any of circuit breaker 20 (shown In FIGS. 1–6), circuit breaker 110 (shown in FIGS. 7–10) or circuit breaker 160 (shown in FIGS. 11 and 12). Base housing assembly 222 includes terminals 224, 226 extending therefrom, and a cover assembly 228 is attached to base housing assembly 222 substantially as described above with respect to the foregoing circuit breaker embodiments.

Base housing assembly 222 includes a lower periphery 230 including arcuate portions 232, 234 and substantially parallel linear portions 236 extending from respective ends of arcuate portions 232, 234. Linear portions 236 provide unobstructed access to mounting through holes 238, 240 extending through breaker cover assembly 228. Arcuate portions 232, 234, together with similarly situated concave portions 141, 143 (shown in FIG. 9) of an outer periphery 139 (shown in FIG. 9) of cover assembly top surface 102 provide for front and back panel mounting of breaker 200 to an electrical distribution panel (not shown in FIG. 13) through one panel cutout configuration.

Figure 14:
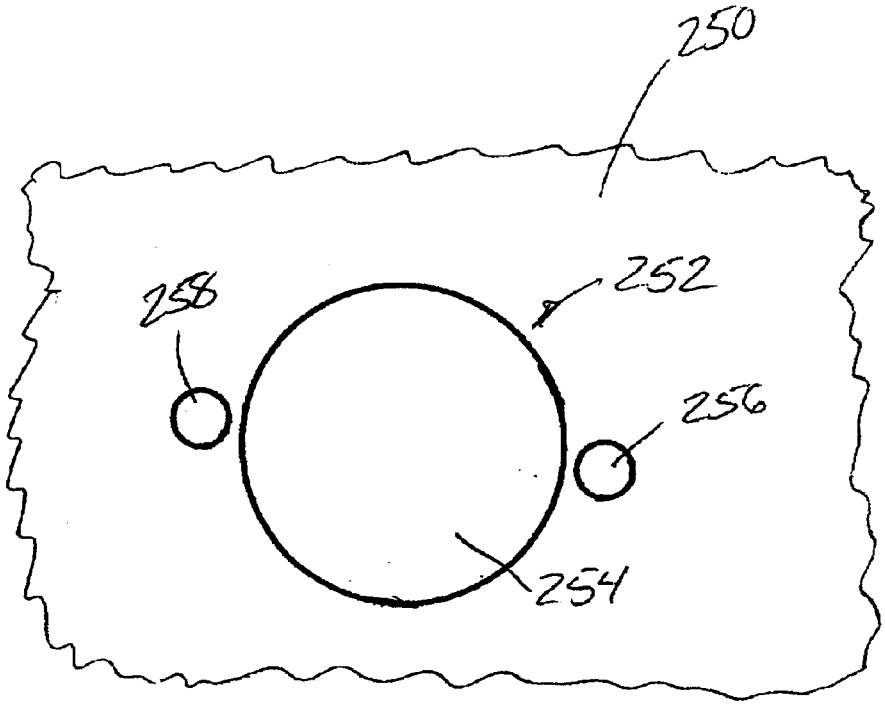
FIG. 14 is a plan view of a breaker panel cut out/mounting detail for the circuit breaker shown in FIG. 13.

FIG. 14 is a plan view of an exemplary portion of a breaker panel 250 including a cutout pattern 252 that facilitates mounting of circuit breaker 220 to panel 250. Cutout pattern 250 includes a large central opening 254 for receiving either base housing assembly outer periphery 230 (shown in FIG. 13) or an outer periphery 139 (shown in FIG. 9) of a top surface of cover assembly 228 (shown in FIG. 13). Thus, breaker 220 may be mounted top-side-up or bottom-side-down to panel 250 without alteration of cutout pattern 250. The dimensions of the outer periphery curved portions are therefore substantially the same on the top and the bottom of breaker 220, and the respective outer peripheries of the top and the bottom are substantially concentric for universal mounting on either side of panel 250. In the illustrated embodiment, central opening 254 is substantially circular and complementary to portions of the breaker top and bottom outer periphery. Thus, one cutout pattern is employed for front panel mounting and back panel mounting of breaker 220.

Cutout pattern 252 further includes aligned apertures 256 and 258 that are positioned with respect to central aperture 254 so that breaker mounting through-holes 238, 240 may be aligned with apertures 256 and 258 for fastening of breaker 220 to panel 250 with known fasteners (not shown). Once fastened to panel 250, the overmolded gasket (described above) of breaker cover assembly 228 provides self-sealing engagement of breaker 220 and panel 250 when installed from the back of panel 250. Thus, a watertight seal is established to prevent fluid contamination of the electrical system associated with panel 254.

An effective and efficient mid-range circuit breaker is therefore provided in automatic reset, manual reset, and manual trip versions suited for mid-range applications. Moreover, the above described circuit breaker features are implemented in a relatively low cost and straightforward fashion from a manufacturing perspective, thereby reducing the cost of the circuit breakers.

While the invention has been described in terms of various specific embodiments, those skilled in the art will recognize that the invention can be practiced with modification within the spirit and scope of the claims.

What is claimed is:

1. A circuit breaker comprising:

a base housing comprising a contact cavity therein;

first and second terminals at least partially located within said contact cavity;

a thermal trigger element fixedly coupled to said first terminal and in electrical contact with said second terminal in normal operation, said thermal element configured to activate and break electrical contact with said second terminal upon a predetermined current condition; and a cover comprising an overmolded gasket.

2. A circuit breaker in accordance with claim 1 wherein said breaker is configured for circuit protection up to about 60 amps in less than 30 Vdc electrical systems.

3. A circuit breaker in accordance with claim 1 wherein said breaker is configured for circuit protection up to about 60 amps in 42 Vdc electrical systems.

4. A circuit breaker in accordance with claim 1 wherein said cover and said base housing each include an outer periphery, said outer periphery of said cover conforming to said outer periphery of said base housing such that the cover may be extended through a panel cutout for back mounting of said circuit breaker to a panel and said base housing may be extended through said panel cutout for front mounting of said circuit breaker to said panel.

5. A circuit breaker in accordance with claim 4, said cover having a top side and a bottom side, said gasket extending over each of said top and bottom sides.

6. A circuit breaker in accordance with claim 1 further comprising a trip actuator, said trip actuator comprising at least one leg and a stabilizer, said trip actuator pivoting about said stabilizer and said leg-positioned to contact said trigger element when said trip element is actuated.

7. A circuit breaker comprising:

a base housing comprising a contact cavity therein;

first and second terminals at least partially located within said contact cavity;

a thermal trigger element extending between said first and second terminals, said thermal trigger element comprising opposing lateral sides and an actuating end; and a trip actuator situated within said contact cavity, said trip actuator comprising opposite legs, a stabilizer extending from said legs, and an engagement surface offset from said stabilizer to produce pivoting movement about the stabilizer, wherein each of said legs comprise a channel receiving a respective one of said lateral sides of said thermal trigger element.

8. A circuit breaker in accordance with claim 7, said base housing contact cavity comprising at least one cradle therein, at least one end of said stabilizer received in said cradle for rocking movement about said stabilizer.

9. A circuit breaker in accordance with claim 7, each of said legs depending from a bifurcated end of said trip actuator.

10. A circuit breaker in accordance with claim 7 further comprising a trip element configured to contact said trip actuator.

11. A circuit breaker in accordance with claim 10, said cover comprising an overmolded gasket.

12. A circuit breaker in accordance with claim 11 further comprising a guard coupled to said cover, said trip element extending through said guard.

13. A circuit breaker in accordance with claim 11, said cover comprising a trip element mechanism through-hole, said gasket comprising a bellows portion located adjacent said through-hole.

14. A circuit breaker in accordance with claim 13, said gasket comprising an outer surface, said gasket extending over substantially all of said outer surface.

15. A circuit breaker comprising:

a base housing comprising a contact cavity therein;

first and second terminals at least partially located within said contact cavity;

a thermal trigger element fixedly coupled to said first terminal and in electrical contact with said second terminal in normal operation, said thermal element configured to activate and break electrical contact with said second terminal upon a predetermined current condition; and a cover attached to said base, said cover comprising an outer surface and an overmolded gasket substantially covering said outer surface.

16. A circuit breaker in accordance with claim 15, said cover comprising a top surface, said circuit breaker further comprising a guard coupled to said top surface.

17. A circuit breaker in accordance with claim 16, said circuit breaker further comprising a trip element, said trip element extending through said guard.

18. A circuit breaker in accordance with claim 17, said trip element and said guard having contrasting colors.

19. A circuit breaker for mounting to an electrical distribution panel, said circuit breaker comprising:

a base housing comprising a contact cavity therein and a lower outer periphery;

first and second terminals at least partially located within said contact cavity;

a thermal trigger element in electrical contact with said first terminal and said second terminal in normal operation, said thermal element configured to activate and break electrical contact with said second terminal upon a predetermined current condition; and a cover assembly attached to said base housing and comprising an upper outer periphery, said upper outer periphery and said lower outer periphery each shaped and dimensioned to be selectively received in the same cut-out of a panel.

20. A circuit breaker in accordance with claim 19 wherein said cover assembly comprises an overmolded gasket.

* * * * *